US005779811A

United States Patent [19]

Machii et al.

[11] Patent Number: 5,779,811

[45] Date of Patent: Jul. 14, 1998

[54] METHOD FOR PEELING OFF DIRT FROM WALL SURFACE BY USING PEELABLE POLYMER MEMBRANE

[75] Inventors: Minori Machii; Nobuyoshi Nanba; Boon Keng Lim; Noboru Sakata; Nobuo Sakurai; Yasuhiko Furusawa, all of Chohu, Japan

[73] Assignee: Kajima Corporation, Tokyo, Japan

[21] Appl. No.: 686,908

[22] Filed: Jul. 26, 1996

[30] Foreign Application Priority Data

May 6, 1994 [JP] Japan ..... 6-094299
Mar. 24, 1995 [JP] Japan ..... 7-066569

[51] Int. Cl.[6] ..... B08B 7/00

[52] U.S. Cl. ..... 134/4; 134/4; 134/26; 134/42; 422/37

[58] Field of Search ..... 134/4, 6, 10, 26, 134/42; 422/28, 37

[56] References Cited

U.S. PATENT DOCUMENTS

| | | | |
|---|---|---|---|
| 3,994,744 | 11/1976 | Anderle et al. | 134/4 |
| 4,199,375 | 4/1980 | Muller | 134/4 |
| 5,342,872 | 8/1994 | Huber | 428/294 |
| 5,505,787 | 4/1996 | Yamaguchi | 134/4 |

FOREIGN PATENT DOCUMENTS

| | | |
|---|---|---|
| 0 178 899 | 4/1986 | European Pat. Off. . |
| 26 03 290 | 8/1977 | Germany . |
| 50-15362 | 2/1975 | Japan . |
| 61-264296 | 11/1986 | Japan . |
| 4-349984 | 4/1992 | Japan . |
| 5-253555 | 5/1993 | Japan . |
| 1 525 465 | 9/1978 | United Kingdom . |

*Primary Examiner*—Jeffrey Snay
*Attorney, Agent, or Firm*—Oblon, Spivak, McClelland, Maier & Neustadt, P.C.

[57] ABSTRACT

Pasty solution 5 made by dissolving membrane-forming polymer 2 and plasticizer 3 in water 4 is applied to wall surface 1 in the form of liquid film 6. The plasticizer 3 improves flexibility and elongation of membrane formable by the membrane-forming polymer. Dirt substance 8 on the wall surface 1 is caused to adhere to the liquid film 6. Water 4 of the liquid film 6 is allowed to evaporate gradually so as to turn the liquid film 6 into flexible membrane 7 which is peelable intact. After dried, the flexible membrane 7 is peeled off intact from the wall surface 1 while carrying the dirt substance 8 adhering thereto.

13 Claims, 5 Drawing Sheets

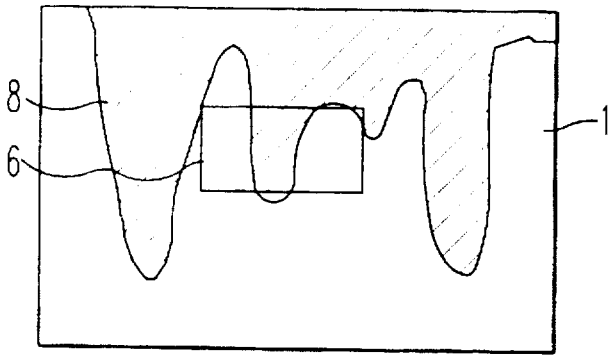
FIG. 3A
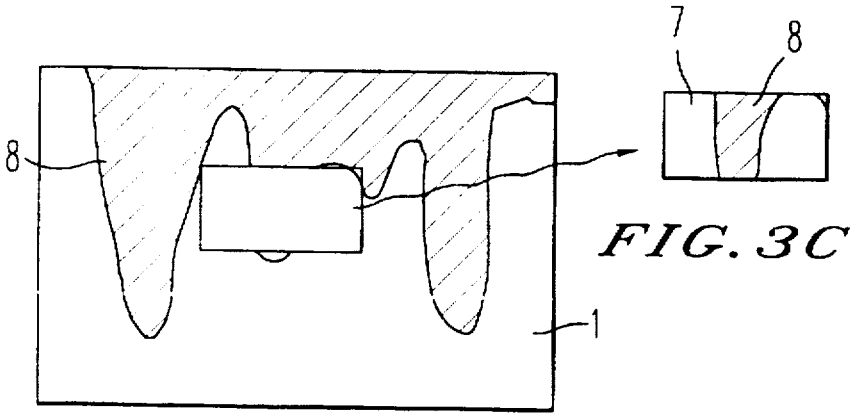
FIG. 3C
FIG. 3B

METHOD FOR PEELING OFF DIRT FROM WALL SURFACE BY USING PEELABLE POLYMER MEMBRANE

BACKGROUND OF THE INVENTION

1. Field of the Invention

This invention relates to a method for peeling off dirt from wall surface by using peelable polymer membrane. In particular, the invention relates to a method for peeling off dirt from the surface of indoor or outdoor wall by forming such pasty flexible membrane on the wall surface that is peelable intact and causing dirt substance to adhere to the flexible membrane and then peeling off the membrane intact from the wall surface together with the dirt adhering thereto.

2. Description of the Prior Art

When being built, the outer surface of concrete wall or tiled wall is finished up so as to provide attractive facade, but esthetic appearance of such wall surface at the time of the finishing tends to be deteriorated as time elapses due to deposit of dirt, such as dust, mold, algae and the like thereon. The kind and amount of dirt to deposit on wall surface vary depending on various conditions such as environmental conditions, duration of exposure, and age of wall material. The phenomenon of increasing dirt deposit with time, however, has been experienced on almost all outdoor wall surfaces and also on the surface of interior wall finishing material. (The surface of both indoor and outdoor walls may be collectively referred to as "wall surface" hereinafter, provided that such wording does not cause any ambiguity.) Recently, the importance of scenic appearance has been growing, and the need of dirt removal from the surface of structural walls is increasing to maintain the attractive scenic appearance, and various investigations and studies have been made on substances of dirt which deposit on wall surface.

Some of the dirt substance, such as dust, mold, algae and the like, adheres so strongly to wall surface that dirt becomes hardly separable. For instance, strongly adhering dirt cannot be removed by simple washing, e.g., by forceful spray of a large amount of water on the wall surface. Especially, dirt which deposits in small recesses on wall surface is sometimes extremely difficult to remove. In fact, to remove dirt from wall surface, washing with brush and cleaning agent has been used mostly. When it is necessary to get sample of dirt from wall surface for investigation, dirt substance is shaved off from the wall surface by a knife and the like tool.

The washing of wall surface with brush and cleaning agent, however, requires hard labor of forcefully scrubbing the entire area where dirt deposits. To clean large wall surface, considerable amount of labor and a long period of time are necessary. If the wall surface to be cleaned is located high, suitable foothold such as scaffold must be assembled in position. As to cleaning agent, due care should be taken in handling and disposal to prevent the cleaning agent from causing environmental problems and from causing health problems of workers. To meet the increasing need of maintenance and recovery of esthetic appearance of wall surface at the time of its original finish up, there is a need for development of a simple method of cleaning wall surface.

Shaving off dirt from wall surface by a knife or the like tool results in collection of dirt substance in a disintegrated manner. When dirt forms community or colony or flock on wall surface, such community of dirt is hardly removable in an aggregated manner by means of such shaving. To analyze how such community of dirt adheres on wall surface, it has been necessary to photograph the dirt community before removal by shaving. Further, direct microscopic observation of the state of dirt community has been difficult heretofore by any of the conventional dirt removing methods.

As an approach to meet the above-mentioned necessity and need for development, a process for cleaning wall surface has been proposed as shown in FIGS. 6A through 6C. Pasty polymer solution 5 is prepared by dissolving peelable-membrane-forming polymer 2 in a solvent 4*a*. The polymer 2 is for instance polyvinyl alcohol which is harmless to the environment, and the solvent 4*a* for it can be water, so that the polymer solution 5 is safe for human being and for both animals and plants. The polymer solution 5 is spread on wall surface 1 in the form of liquid film 6. Dirt substance 8 adheres to the liquid film 6 due to its pastiness. As being dried, the liquid film 7 turns into self peeling membrane pieces 7*a*, which warp by themselves and peel off from the wall surface 1 while carrying dirt substance 8 adhering thereto. Thereby, the wall surface 1 is cleaned without brushing or scrubbing, and without using any harmful chemicals.

The proposed process of FIGS. 6A through 6C has a shortcoming in that the self peeling membrane pieces 7*a* tend to be scattered over a certain ground area surrounding the wall surface. Although the membrane pieces 7*a* are chemically safe, to prevent any unforeseeable hazard due to the scattering of them, it has been necessary to collect them and treat them for ultimate disposal. Such collection and treatment requires certain amount of labor. Besides, some of the membrane pieces 7*a* fail to peel by themselves and remain on the wall surface 1, and it is often necessary to use the conventional brushing or scrubbing in addition to the above-mentioned collection and treatment.

SUMMARY OF THE INVENTION

Thus, an object of the invention is to solve the above shortcoming of the self peeling membrane pieces 7*a*.

The inventors noted that if flexible membrane which is peelable intact is formed on wall surface and if dirt substance on wall surface is caused to adhere thereto, such flexible membrane may be removed intact from the wall surface by peeling it from one end thereof, so that it becomes possible to keep the flexible membrane in one piece and to prevent scattering of the membrane pieces.

On the other hand, such flexible membrane has been difficult to produce from aqueous solution of polymer. Although peelable polymer membranes can be formed on wall surface by spreading aqueous solution of certain environmentally safe polymer thereon and then drying, the membranes thus formed are rather hard and tend to be cracked into pieces when being removed from the wall surface. There are water insoluble polymers, such as thermoplastic urethane, which can form the desired flexible membrane, but with such water insoluble polymers, special treatment is necessary to ensure safety before disposal after use. It has not been known to form such flexible membrane by water soluble harmless polymer on wall surface that membrane is peelable intact.

After series of studies and tests, the inventors have found that if suitable plasticizer is added to aqueous solution of certain water soluble and environmentally safe polymer, a flexible membrane which is peelable intact can be formed on wall surface by spreading the aqueous solution on the wall surface and drying it.

According to an embodiment of the method of the invention for peeling off dirt from wall surface, a pasty aqueous polymer solution is prepared by dissolving membrane-forming polymer and plasticizer in water, the plasticizer being capable of improving flexibility and elongation of membrane formable by the polymer, and the pasty polymer solution is applied over dirt on wall surface in the form of liquid film. The dirt on the wall surface is caused to adhere to the liquid film, and water of the liquid film is evaporated so as to dry the liquid film into flexible membrane which is peelable intact from the wall surface. Finally, the flexible membrane carrying the dirt substance adhering thereto is peeled off intact from the wall surface.

BRIEF DESCRIPTION OF THE ACCOMPANYING DRAWINGS

For a better understanding of the invention, reference is made to the accompanying drawings, in which FIGS. 1A through 1D show a method of cleaning wall surface according to the invention, including steps of spreading pasty polymer solution on wall surface in the form of liquid film, drying the liquid film to provide peelable membrane, and peeling off the membrane intact;

FIGS. 3A through 3C show a method of sampling dirt substance from wall surface according to the invention, including similar steps to those of FIG. 1;

Throughout different views of the drawings, like parts are designated by like numerals.

DESCRIPTION OF THE PREFERRED EMBODIMENT

Figure 1A:
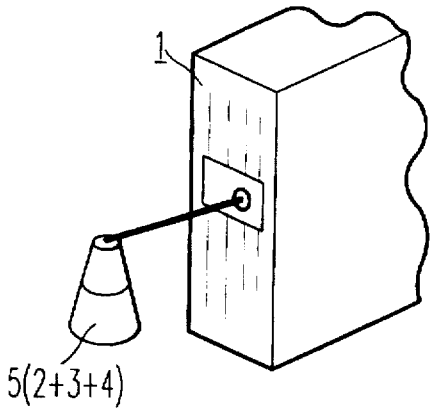
Figure 1B:
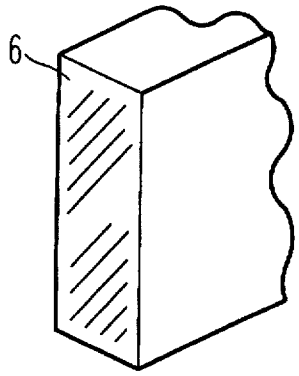
Figure 1C:
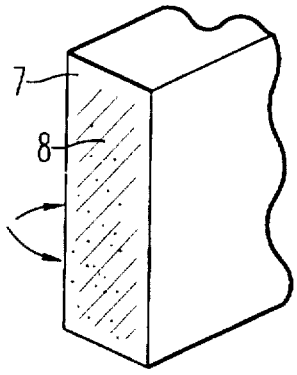
Figure 1D:
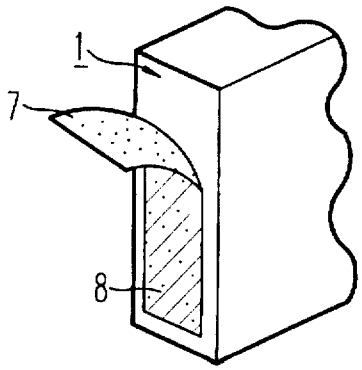

Referring to FIGS. 1A through 1D, a process for cleaning wall surface according to the method of the invention will now be described. A pasty polymer solution 5 is made by dissolving polymer 2 and plasticizer 3 in water 4. The polymer solution 5 is at first applied to wall surface 1 in the form of liquid film 6 as shown in FIGS. 1A and 1B, and dirt substance 8 on the wall surface 1 is caused to adhere to the liquid film 6 due to its pastiness as shown in FIG. 1C. Water 4 is allowed to evaporate so as to turn the liquid film 6 gradually into flexible membrane 7 which is peelable intact. As a final step of the cleaning, the flexible membrane 7 is peeled off intact from the wall surface 1 while carrying the dirt substance 8 adhering thereto. The peeling may start from one end of the membrane 7 as shown in FIG. 1D.

Properties of the polymer 2 and the plasticizer 3 are such that they both dissolve in the water 4 to yield pasty solution 5, and produce a uniform liquid film 6 when spread on the wall surface 1, and turn into a flexible membrane 7 when being dried. The flexible membrane 7 is peelable intact; namely, it is so flexible, tenacious and adherent that it can be peeled while keeping the membrane shape without being torn. The polymer 2 to be dissolved in the polymer solution 5 can be one or more polymers selected from the group consisting of polyvinyl alcohol, carboxymethylcellulose, and polyvinyl acetate. For use as a material of the flexible film 7, the polyvinyl alcohol 2 should have a degree of polymerization of 500–5,000, preferably 1,000–3,000, and a degree of saponification of 90–99 mole %. The plasticizer 3 to be mixed with the polymer 2 in the method of the present invention is glycerol and/or propylene glycol.

Polyvinyl alcohol and other polymers listed above for producing the membrane 7 have been used as material for cosmetic, and they are safe and free from harmful effects on workers' health. In addition, the above polymers may be reused in a cyclic manner by dissolving in water without necessitating any special solvent, so that they are a kind of soft material as far as their effects on environment are concerned. Glycerol and propylene glycol, possible ingredient(s) in the polymer solution 5 of the invention, have also been used as materials for cosmetics, and they are also safe.

The concentration of polymer 2 in the pasty solution 5 can be adjusted depending on conditions, such as the type and circumstance of wall surface 1 and kind of dirt substance 8 depositing on wall surface 1. The inventors have found out through experiments that the polymer concentration in the pasty solution 5 is preferably 5 to 20% by weight. If the concentration is below 5%, the formation of the liquid film 6 becomes difficult when the liquid 5 is spread on wall surface 1. On the other hand, if the concentration exceeds 20%, the polymer solution 5 becomes too sticky to be spread uniformly.

The plasticizer 3 to be used in the polymer solution 5 must be also water soluble and should be compatible with the above-mentioned polymer 2. Preferable materials for such plasticizer are propylene glycol and/or glycerol. The ratio of the plasticizer 3 to the polymer 2 in the polymer solution 5 is 0.5 to 15% by weight, because the concentration of the plasticizer 3 in such range is effective in producing the flexible membrane 7 which is peelable intact.

[Experiment]

To check the effects of the plasticizer 3 in the method of the invention, the following specimens were prepared.

A reference aqueous solution $\mathbf{5}_r$ containing 15% by weight of polyvinyl alcohol (PVA) 2 with no plasticizer 3. (PVA used was PVA-120 made by Kabushikikaisha KURARE, with a degree of polymerization of 2,000 and a degree of saponification of above 98 mole %).

A test solution $\mathbf{5}_{t1}$, made by adding glycerol to a portion of the reference aqueous solution $\mathbf{5}_r$ at a rate of 2% by weight of glycerol based on the weight of PVA 2.

A test solution $\mathbf{5}_{t2}$, made by adding glycerol to another portion of the reference aqueous solution $\mathbf{5}_r$ at a rate of 5% by weight of glycerol based on the weight of PVA 2.

Membrane specimens $\mathbf{7}_r$, $\mathbf{7}_{t1}$, and $\mathbf{7}_{t2}$ made by spreading the reference and test solutions $\mathbf{5}_r$, $\mathbf{5}_{t1}$, and $\mathbf{5}_{t2}$ on a wall surface 1, respectively, so as to form liquid films 6 thereof, and then drying such liquid films 6 into the specimens of the flexible membrane 7.

Tension tests were carried out on the membrane specimens $\mathbf{7}_r$, $\mathbf{7}_{t1}$, and $\mathbf{7}_{t2}$. The results are shown in Table 1.

One can see from Table 1 that, as compared with the PVA membrane specimen $\mathbf{7}_r$ without any plasticizer, the tensile strength of the PVA membrane 7 is reduced by addition of glycerol therein, but its elongation at break is greatly increased by the addition of glycerol.

TABLE 1

| Kind of test | Membrane specimen $7_t$ PVA 15% | Membrane specimen $7_{t1}$ PVA 15% + G 2%* | Membrane specimen $7_{t2}$ PVA 15% + G 5%* |
|---|---|---|---|
| Width (mm) | 10.0 | 10.0 | 10.0 |
| Thickness (mm) | 0.1 | 0.08 | 0.04 |
| Tensile modulus of elasticity ($N/mm^2$) | 3,500 | 126 | 1,350 |
| Tensile strength | | | |
| Load (N) | 97.1 | 24.2 | 24.0 |
| Strength ($N/mm^2$) | 97.1 | 30.2 | 60.1 |
| Elongation at** break (%) Lo = 100 mm | 2 | 120 | 231 |

*G 2% and G 5% stand for 2% and 5% by weight of glycerol, respectively, based on the weight of PVA.
**Elongation at break (%) Lo = 100 mm stands for elongation at break (%) as measured by pulling a specimen with an initial length of 100 mm.

In short, the inventors have found that the flexibility and tenacity of membrane of PVA can be improved by adding suitable water soluble plasticizer compatible therewith, and the invention is based on such finding.

Referring to FIG. 1A, the pasty aqueous polymer solution 5 containing the polymer 2 and the plasticizer 3 is spread on the wall surface 1 by any suitable means; such as, spraying, squeezing from a funnel-like holder, brushing, using rollers, and the like. According to experiments of the inventors, the thickness of the liquid film 6 when formed on the wall surface 1 is preferably 10–300 μm, and more preferably 20–50 μm. If the thickness of the film 6 is more than 300 μm, it takes too much time for the liquid film 6 to dry and produce the flexible membrane 7. On the other hand, it is very difficult to form a liquid film 6 which is thinner than 10 μm.

Water 4 in the liquid film 6 gradually evaporates, and the liquid film 6 dries up and becomes the flexible membrane 7 as shown in FIG. 1C. It may take several hours for the liquid film 6 to become the flexible membrane 7 in case of natural drying, but such drying time can be shortened to about 5 to 10 minutes by blowing hot air at 40°–60° C.

When the flexible membrane 7 is formed, the dirt substance 8 on the wall surface 1 is grasped by the polymer of the flexible membrane 7. Further, dirt substance 8 coming from outside toward the wall surface 1 is intercepted by the flexible membrane. In this case, the wall surface 1 is protected from the deposit of dirt substance 8 by the flexible membrane 7. After transfer of dirt substance 8 from the wall surface 1 to the flexible membrane 7, or at the end of the protection of the wall surface 1 against dirt substance 8 from outside, the flexible membrane 7 is removed from the wall surface 1. For the removal, a corner of the flexible membrane 7 may be manually forced to peel off as shown in FIG. 1D. The entire flexible membrane 7 can be peeled off intact from the wall surface 1 without necessitating any special tool. It is also possible to sever a portion of the flexible membrane 7 by a suitable cutter (not shown) before removing from the wall surface 1, and only the severed portion of the membrane 7 can be removed, for instance as a test piece carrying sample of dirt substance 8.

Figure 2A:
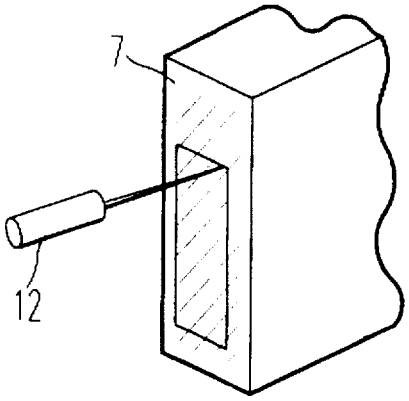
FIGS. 2A and 2B show modifications of the method of FIG. 1 by providing marking and protective coating, respectively, on peelable membrane which is formed on wall surface.
Figure 2B:
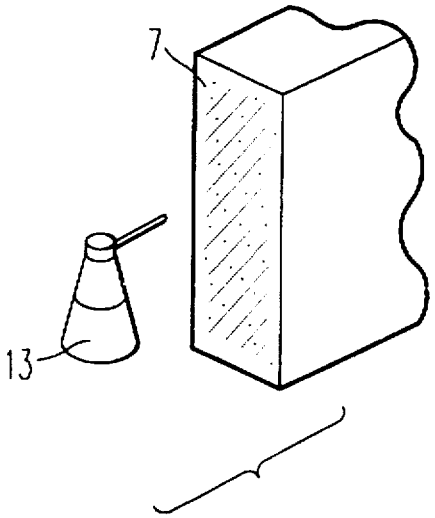

Referring to FIG. 2A, a suitable marking, such as identification of that part of the wall surface 1 which is covered by the specific flexible membrane 7, may be drawn on the outer surface thereof by a marker means 12. An extra coating, such as fire-proof coating, may be provided on the outer surface of the flexible membrane 7 by a spray means 13 or the like, as shown in FIG. 2B.

FIGS. 3A through 3C illustrate an embodiment of the invention, which suits for sampling of dirt substance 8 from wall surface 1. The pasty polymer solution 5 of FIG. 1A, with the same polymer concentration as that for wall surface cleaning, is spread on that portion of wall surface 1 where dirt substance 8 to be sampled exists, so as to produce a piece of liquid film 6 of 10–300 μm thick thereon, as shown in FIG. 3A. The piece of liquid film 6 can be of any suitable shape for sampling, e.g., rectangular. That dirt substance 8 on wall surface 1 which is to be sampled adheres to the liquid film 6 due to its pastiness. Upon evaporation of water 4, the liquid film 6 becomes flexible membrane 7 which is peelable intact. The flexible membrane 7 carrying the dirt substance 8 adhering thereto can be peeled off intact, i.e., while keeping the initial shape of the liquid film 6 such as rectangular shape, as shown in FIGS. 3B and 3C.

With the sampling method of FIGS. 3A through 3C, the entire dirt substance 8 in a particular portion of the wall surface 1 can be removed and transferred onto the flexible membrane 7 as a whole in the form of community, colony, or flock, so that it becomes possible to observe morphology, pattern, color, and other state of such entire dirt substance 8 on the peeled flexible membrane 7. If polymer 2 in the pasty polymer solution 5 is polyvinyl alcohol, carboxymethylcellulose, or polyvinyl acetate copolymer, then the flexible membrane 7 is transparent, and the sampled dirt substance 8 can be directly observed by an optical or other microscope.

Further, chemical analysis of the dirt substance 8 as sampled by the method of FIGS. 3A through 3C can be effected by dissolving the peeled flexible membrane 7 with such dirt substance 8 in a suitable organic or inorganic solvent or acid, and conducting component analysis of the solution. More particularly, the flexible membrane 7 is made of the polymer 2, and hence if the components of the polymer 2 are deducted from the outcome of the analysis of the combination of the dirt substance 8 and the flexible membrane 7, then the remainder will give components of the dirt substance 8. It is also possible to separate the dirt substance 8 from the polymer 2 forming the flexible membrane 7 by centrifugal separation of that solution which is made by dissolving the flexible membrane 7 with the dirt substance 8 in an organic or inorganic solvent or acid.

Figure 4A:
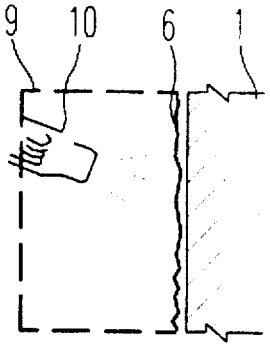
FIGS. 4A and 4B show methods for accelerating the drying of liquid film of polymer solution on wall surface.
Figure 4B:
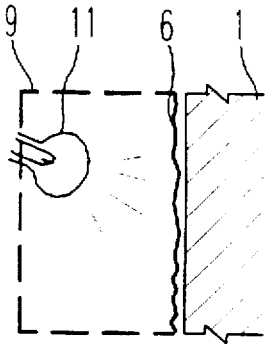

FIGS. 4A and 4B depict further embodiments of the method of the invention, in which liquid film 6 applied to wall surface 1 is quickly dried by hot wind or hot light. Although the method of the invention allows to leave the liquid film 6 on the wall surface 1 until it naturally dries, but it takes time of several hours to several weeks for the liquid film 6 to dry and become peelable, depending on various conditions. In the embodiment of FIG. 4A, hot wind from a hot-air blower 10 dries the liquid film 6, and in the embodiment of FIG. 4B, light beam from a lamp 11 dries the liquid film 6. When hot wind or light beam is used, the process of drying the liquid film 6 up to a peelable state can be expedited to about ten minutes to half a day after the application of the pasty polymer solution 5 to wall surface.

Thus, when the method of the invention is used to clean wall surface, the time necessary for wall surface cleaning can be shortened. In FIGS. 4A and 4B, the dotted line 9 represents vinyl resin sheet which covers wall surface 1 when it rains. If a suitable cover agent is applied to the liquid film 6 of polymer 2, the polymer 2 can be gelled, and covering by the vinyl sheet 9 can be dispensed with unless very heavy rain is encountered. An example of such cover agent is alum for carboxymethylcellulose.

Figure 5:
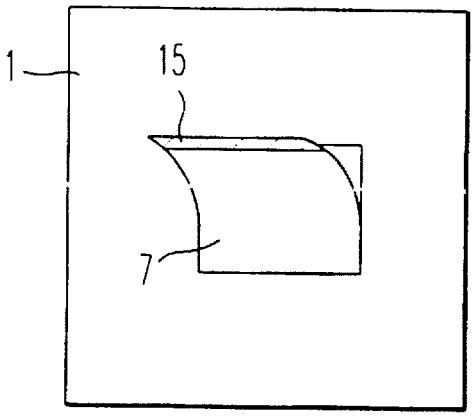
FIG. 5 shows a method for facilitating removal of flexible membrane from wall surface by attaching a knob portion to one end of such membrane.
Figure 6C:
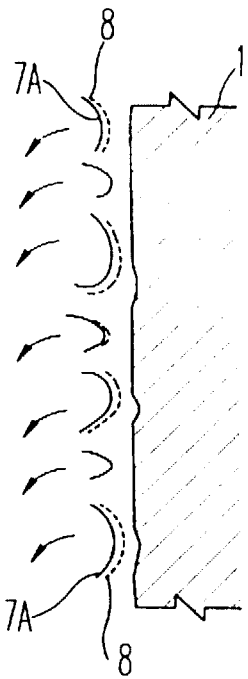
FIGS. 6A through 6C show a conventional method for cleaning wall surface by using peelable membrane.
Figure 6B:
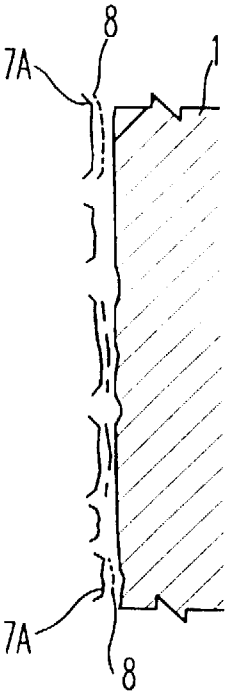
Figure 6A:
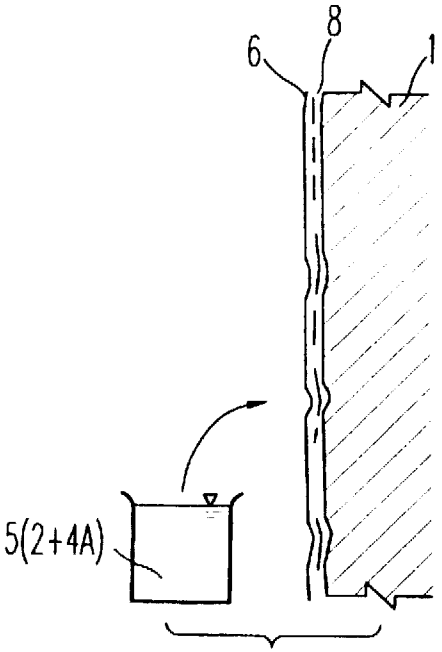

FIG. 5 shows the use of a knob portion 15 as an integral part of flexible membrane 7. Depending on the type and concentration of polymer 2, the flexible membrane 7 sometimes can become hard to peel. In such case, a knob material sheet, such as a piece of gum tape, is stuck or adhered onto such portion of the wall surface 1 where liquid film 6 of polymer ends, and pasty polymer solution 5 is applied on the wall surface 1 while covering the knob material sheet. When the liquid film 6 is dried, a knob portion 15 is formed at the knob material sheet, because it is now a part of the flexible membrane 7 due to the presence of the polymer 2 on the outer surface thereof and yet its inner surface is freely separable from the wall surface 1. By holding the knob portion 15 and pulling it away from the wall surface 1, the flexible membrane 7 can be easily peeled away from the wall surface 1.

It is noticed that, among different kinds of dirt substance 8, those microorganisms that attach to the wall surface 1 and multiply thereon (to be referred to as "attached microorganisms"), such as micro-algae, are difficult to remove even if forcefully scraped with scrubbing-brush. With the peeling method of the invention, attached microorganisms can be easily peeled off. Further, highly effective removal of attached microorganisms from wall surface 1 is possible by adding an algae-killer in the pasty polymer solution 5 and applying such killer added solution 5 to the wall surface 1.

More specifically, pasty polymer solution 5 containing about 50 ppm (parts per million) of hypochlorous acid can be applied to wall surface 1 in the form of liquid film 6, so as to cause the attached microorganisms on the wall surface 1 to adhere to the liquid film 6. Hypochlorous acid in the liquid film 6, acting as a microbicide or algae-killer, not only kills those attached microorganisms which have adhered to the membrane 7 but also exudes on to the wall surface 1 to kill the attached microorganisms thereon. That portion of the microbicide or algae-killer which has exuded onto the wall surface 1 acts to keep the wall surface 1 sterilized as far as the attached microorganisms inclusive of algae are concerned, even after the removal of the flexible membrane 7 therefrom. Hence, re-attaching and multiplication of microorganisms on the sterilized wall surface 1 become difficult, and the cleaning effects lasts for a long period of time.

It should be understood that the present disclosure has been made only by way of example and that numerous changes in the details, such as the ingredients of polymer solution and the combination and arrangement of parts, may be resorted to without departing from the spirit and scope of the invention.

For instance, although the invention has been described by referring to method of peeling off dirt from wall surface through the use of polymer alone, it is also possible to add a suitable filler, such as soap, clay, fly ash, blast furnace slag, and the like, into the pasty polymer solution 5. Such filler is cheaper than the polymer 2, and has loading effect and tends to improve the peelability of the flexible membrane 7.

Further, when the cohesion between the wall surface 1 and the flexible member 7 is comparable with or larger than the strength of the flexible member 7, it may become difficult to peel off the flexible film 7 from the wall surface 1, and the flexible film 7 may be broken if an unduly large force is applied to it for peeling. In such case, after a flexible membrane 7 is formed, a second liquid film 6 may be applied on the first flexible film 7 by spreading the polymer solution 5 thereon, so that with elapse of time a second flexible membrane 7 is gradually formed on the first one and a two-layered integral flexible membrane 7 with a greater strength than that of the first membrane 7 alone is produced. Thereby, the two-layered flexible membrane 7 become fairly easily peelable from the wall surface 1. It is also possible to apply three or more layers of the flexible membranes 7 to the first membrane 7 so as to render sufficiently larger mechanical strength for peeling from the wall surface 1.

In improving the mechanical strength of the flexible membrane 7 by the above multiple coating of the polymer solution 5, a fiber reinforcement may be inserted between the adjacent layers of the flexible membranes 7; more specifically, a sheet of reinforcing cloth, such as gauze, is spread on the preceding, e.g., first, flexible membrane 7 and then the polymer solution 5 is applied on the cloth in the form of liquid film 6 while permeating the cloth with the polymer solution 5, which liquid film 6 will later dry up into a next, e.g., second, flexible membrane 7. Thereby, an integral multi-layered, e.g., two-layered, flexible membrane 7 having the reinforcing cloth sandwiched between the adjacent layers thereof will be produced. The reinforcing cloth must be either bondable to the flexible membrane 7 or permeable to the polymer solution 5 so that the flexible membranes 7 on opposite surfaces of the reinforcing cloth can be firmly joined together by the cloth or by the polymer solution 5 held by the reinforcing cloth.

As to the above-mentioned fiber reinforcement, it is also possible to disperse fibers of suitable length, e.g., 5 to 10 mm long fibers, in the polymer solution 5 before spreading for making a liquid film 6, so that the mechanical strength of each single flexible membrane 7 may be improved.

As described in detail in the foregoing, the method of peeling off dirt from wall surface by using peelable polymer membrane according to the invention is to apply a polymer solution on wall surface in the form of liquid film so as to cause dirt substance on the wall surface to adhere to the liquid film, to dry the liquid film into such flexible membrane which can be peeled intact away from the wall surface, and to peel off the dirt substance from the wall surface together with the flexible membrane. Hence, the following outstanding effects can be achieved.

(1) When the method of the invention is used for cleaning wall surface, dirt on the wall surface can be removed simply by applying pasty polymer solution in the form of liquid film on the wall surface to be cleaned.

(2) Polymer membrane carrying dirt adhered thereto can be reused after peeling away from the wall surface. Thus, it is free from such environmental contamination which has been experienced with soap.

(3) Materials used in the method are inexpensive, so that total cost of wall surface cleaning can be kept low.

(4) Time necessary for wall surface cleaning can be shortened to about half an hour to half a day by accelerating the drying of liquid film by using hot wind or hot light.

(5) The effect of wall surface cleaning can be maintained for a long time, by using polymer solution containing a sterilizing agent so as to keep the wall surface sterilized even after the peeling off of the flexible membrane therefrom.

(6) When used for sampling dirt, the morphology and patterns of dirt substance on wall surface can be sampled intact.

What is claimed is:

1. A method of cleaning a wall surface by removing dirt therefrom, comprising the steps of applying a pasty polymer solution on the wall surface in the form of a liquid film, said solution being made by dissolving a membrane-forming polymer and a plasticizer in water, said plasticizer being capable of providing flexibility and elongation of the membrane formed by the polymer solution causing the dirt substance on the wall surface to adhere to the liquid film, evaporating water of the liquid film so as to dry the liquid film to form the flexible membrane which is peelable intact from the wall surface, and removing the dirt substance from the wall surface by the peeling off of the flexible membrane intact from the wall surface together with the dirt substance adhering thereto, wherein 5–10 mm long fibers are dispersed in the pasty polymer solution.

2. A method of peeling off dirt from a wall surface by using a peelable polymer membrane, comprising the steps of applying pasty polymer solution over dirt on wall surface in the form of a liquid film, said solution being made by dissolving a membrane-forming polymer and a plasticizer in water, said plasticizer being capable of providing flexibility and elongation of the membrane formed by the polymer solution, causing the dirt on the wall surface to adhere to the liquid film, evaporating water of the liquid film so as to dry the liquid film to form the flexible membrane which is peelable intact from the wall surface, and peeling off the flexible membrane from the wall surface together with the dirt adhering thereto, wherein 5–10 mm long fibers are dispersed in the pasty polymer solution.

3. A method of peeling off dirt as set forth in claim 2, wherein said membrane-forming polymer is at least one polymer selected from the group consisting of polyvinyl alcohol, carboxymethylcellulose, and polyvinyl acetate.

4. A method of peeling off dirt as set forth in claim 2, wherein said plasticizer is at least one compound selected from the group consisting of glycerol, propylene glycol, ethylene glycol, and polyethylene glycol.

5. A method of peeling off dirt as set forth in claim 2, wherein said pasty polymer solution contains 5–20% by weight based on the solution of said membrane-forming polymer and 0.5–15% by weight based on the membrane-forming polymer of said plasticizer.

6. A method of peeling off dirt as set forth in claim 2, wherein a filler is added in the pasty polymer solution.

7. A method of peeling off dirt as set forth in claim 2, wherein a sterilizing agent is added in said pasty polymer solution, and the wall surface is sterilized by that portion of the sterilizing agent which exudes from the membrane.

8. A method of peeling off dirt as set forth in claim 7, wherein the sterilizing agent is hypochlorous acid.

9. A method of peeling off dirt as set forth in claim 2, the method comprising a further step of spreading the polymer solution on the outer surface of said flexible membrane in the form of a second fluid film on said flexible membrane, so as to form a second flexible membrane layer upon drying of said second liquid film, which layer is integrally secured to said flexible membrane on the wall surface so as to result in a composite two-layered flexible membrane peelable intact from the wall surface.

10. A method of peeling off dirt as set forth in claim 9, wherein said spreading of the polymer solution on that flexible membrane which is formed by preceding spreading of said polymer solution is repeated in such manner as to result in a composite multi-layered flexible membrane peelable intact from the wall surface.

11. A method of peeling off dirt as set forth in claim 10, wherein a fiber reinforcement is placed on each flexible membrane before said spreading of the polymer solution thereon, said fiber reinforcement being bondable to said flexible membrane, so that said fiber reinforcement is sandwiched by adjacent flexible membranes in the composite multi-layered flexible membrane.

12. A method of peeling off dirt as set forth in claim 11, wherein said fiber reinforcement is a cloth which is bondable to said flexible membrane.

13. A method of peeling off dirt as set forth in claim 11, wherein said fiber reinforcement is a cloth which is permeable to said polymer solution so that said flexible membranes on opposite surfaces of the cloth are firmly joined together by the polymer solution held by the cloth.

* * * * *